US009033333B2

(12) United States Patent
Li et al.

(10) Patent No.: US 9,033,333 B2
(45) Date of Patent: May 19, 2015

(54) ABSORBING MECHANISM

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Bing Li, Shenzhen (CN); Bo Yang, Shenzhen (CN); Yong Zhang, Shenzhen (CN)

(73) Assignees: HONG FU JIN PRECISION INDUSTRY (Shenzhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 146 days.

(21) Appl. No.: 13/804,152

(22) Filed: Mar. 14, 2013

(65) Prior Publication Data

US 2014/0010627 A1 Jan. 9, 2014

(30) Foreign Application Priority Data

Jul. 3, 2012 (CN) ..... 2012 1 02271259

(51) Int. Cl.

| | |
|---|---|
| ***B65H 3/08*** | (2006.01) |
| ***B65H 1/04*** | (2006.01) |
| ***B65H 3/48*** | (2006.01) |
| ***B65H 3/56*** | (2006.01) |
| *B65H 33/00* | (2006.01) |

(52) U.S. Cl.

CPC ..... *B65H 3/0816* (2013.01); *B65H 3/08* (2013.01); *B65H 2511/30* (2013.01); *B65H 2301/541* (2013.01); *B65H 2301/422* (2013.01); *B65H 2220/01* (2013.01); *B65H 33/00* (2013.01); *B65H 1/04* (2013.01); *B65H 3/48* (2013.01); *B65H 3/56* (2013.01); *B65H 2402/5441* (2013.01); *B65H 2405/1142* (2013.01); *B65H 2701/1752* (2013.01)

(58) Field of Classification Search

USPC ..... 221/278; 239/593, 597; 271/105, 17, 271/18.1, 20, 207, 3.05, 3.11, 97, 98; 414/788.9, 795.5, 795.7, 796.5, 796.6, 414/796.9, 797, 797.1; 493/416

See application file for complete search history.

(56) References Cited

U.S. PATENT DOCUMENTS

| | | | | | |
|---|---|---|---|---|---|
| 1,133,711 | A * | 3/1915 | Cornelius | 239/591 |
| 4,678,176 | A * | 7/1987 | Roller | 271/94 |
| 4,886,261 | A * | 12/1989 | Jeschke | 271/11 |
| 5,984,622 | A * | 11/1999 | Schum et al. | 414/796 |
| 6,468,025 | B1 * | 10/2002 | Stumpf et al. | 414/797 |
| 6,615,857 | B1 * | 9/2003 | Sinha et al. | 137/14 |
| 6,629,692 | B2 * | 10/2003 | Allner et al. | 271/98 |
| 6,955,348 | B2 * | 10/2005 | Koga | 271/97 |

(Continued)

*Primary Examiner* — Gregory Adams

(74) *Attorney, Agent, or Firm* — Novak Druce Connolly Bove + Quigg LLP

(57) ABSTRACT

An absorbing mechanism includes a positioning member, an absorbing member, and at least one separating member. The positioning member defines a receiving chamber, for receiving a plurality of workpieces. The attaching member is constructed for absorbing the workpieces. The at least one separating member comprises a main body and a detaching portion. The main body is mounted on the positioning member. The detaching portion protrudes from the main body toward an axis of the positioning member, and forming an inclined surface away from the main body. The inclined surface defines at least one blow hole. The inclined surface towards the receiving chamber.

13 Claims, 4 Drawing Sheets

(56) References Cited

U.S. PATENT DOCUMENTS 7,753,360 B2 * 7/2010 Takeuchi et al. ..... 271/110
7,866,660 B2 * 1/2011 Ishida ..... 271/171
7,942,403 B2 * 5/2011 Dangelewicz et al. ..... 271/170

* cited by examiner

ABSORBING MECHANISM

BACKGROUND

1. Technical Field

The present disclosure relates to absorbing mechanisms, particularly to an absorbing mechanism for absorbing sheet-like workpieces.

2. Description of Related Art

An absorbing mechanism maybe mounted to a robot, for automatically absorbing sheet-like workpieces, such as papers, plastic films, and so on. However, because the sheet-like workpieces are stacked together, static electricity or vacuum may be easily created between two adjacent workpieces which makes separating and absorbing the workpieces difficult.

Therefore, there is room for improvement in the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
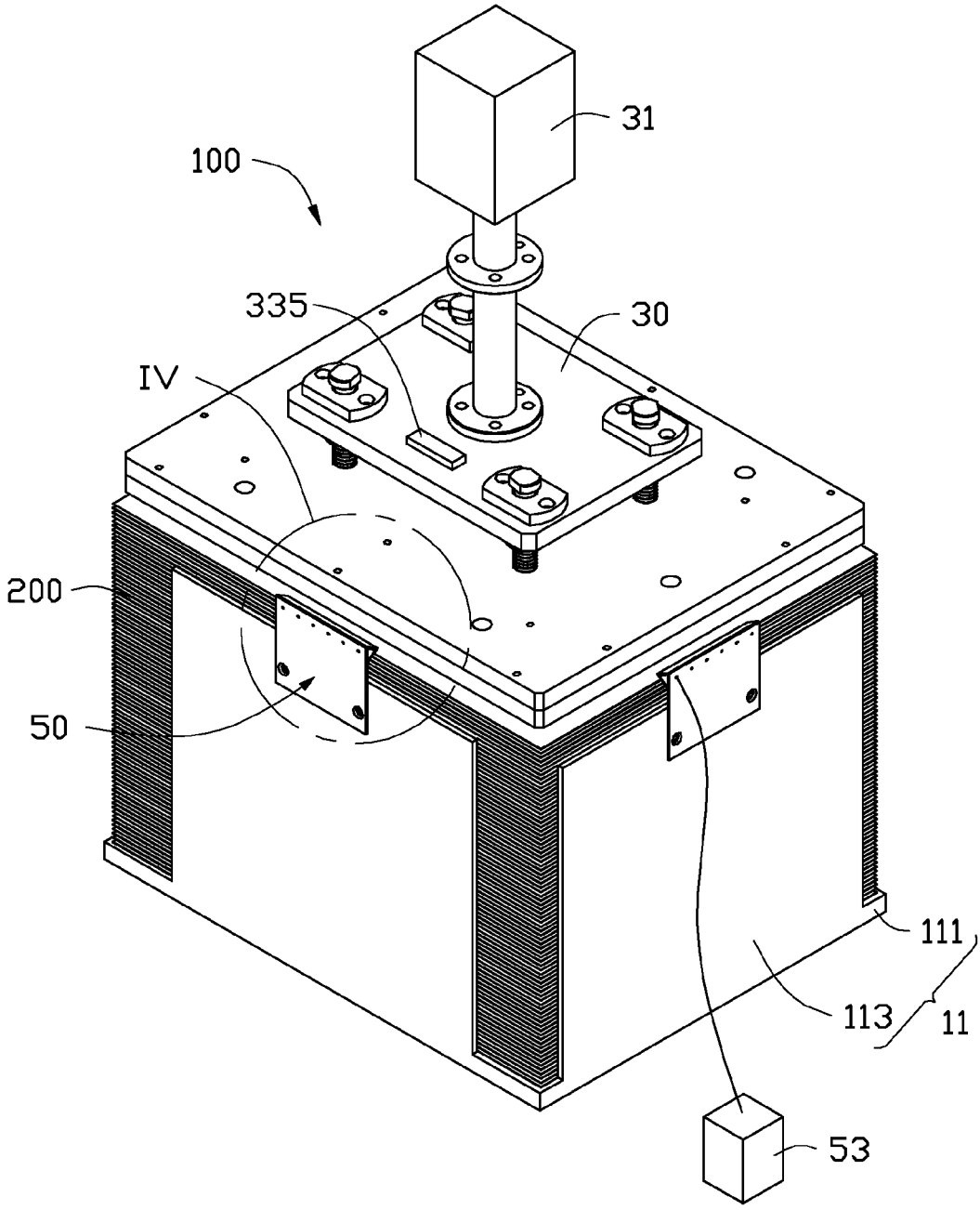
FIG. 1 is an isometric view of an embodiment of an absorbing mechanism including a separating member.
Figure 2:
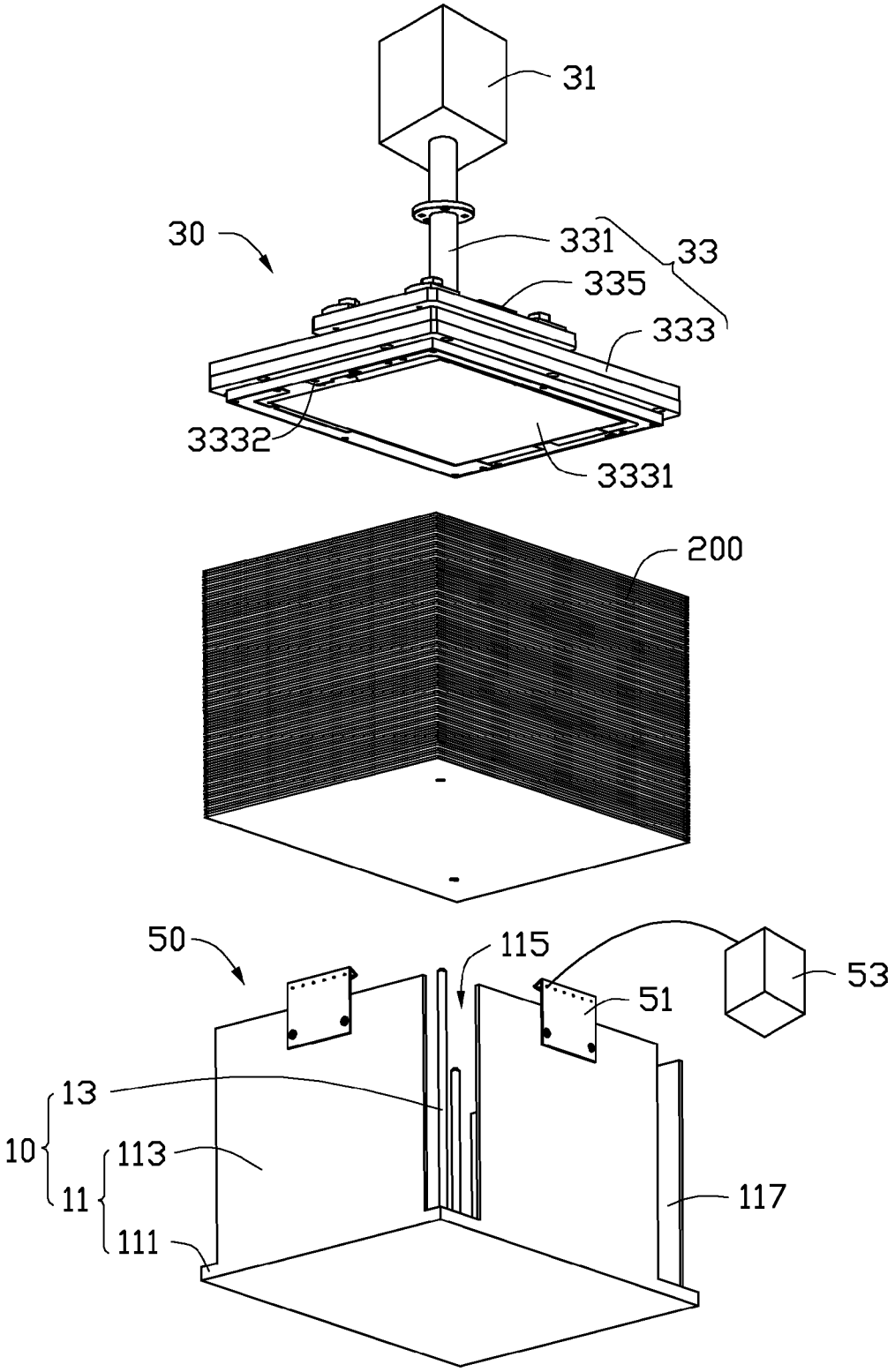
FIG. 2 is an exploded, isometric view of the absorbing mechanism shown in FIG. 1.
Figure 3:
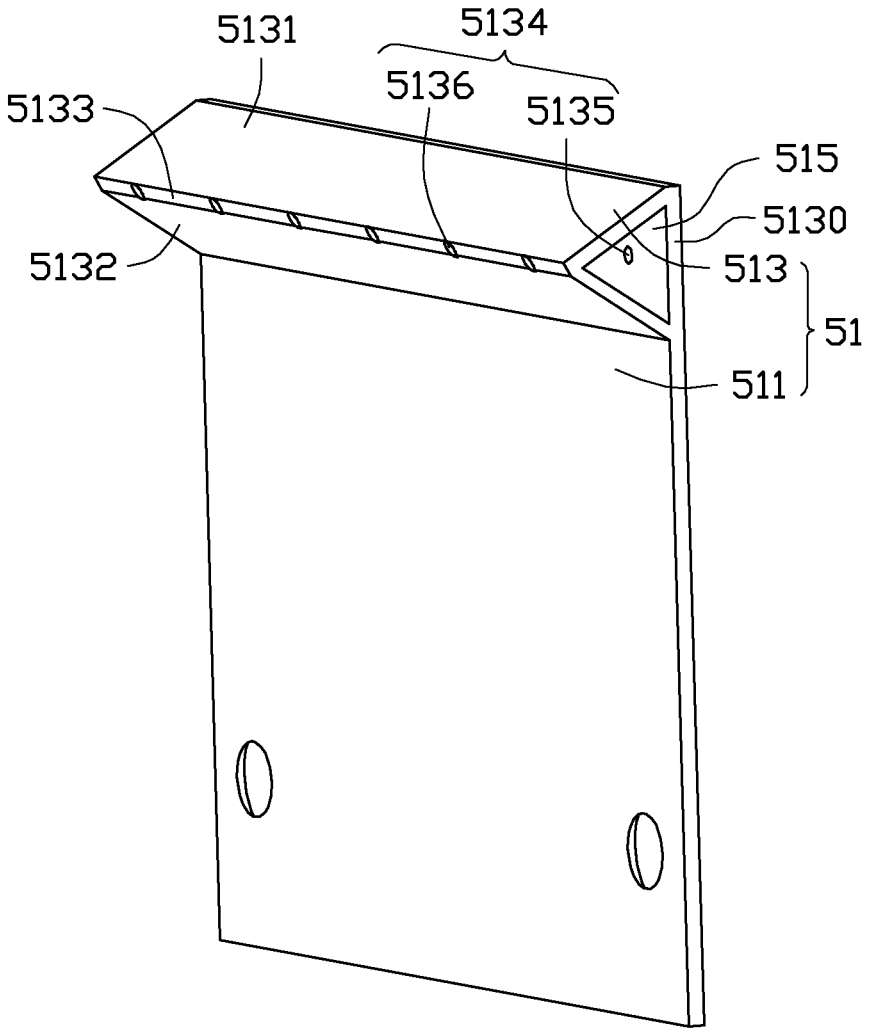
FIG. 3 is an isometric view of the separating member of the absorbing mechanism shown in FIG. 1.
Figure 4:
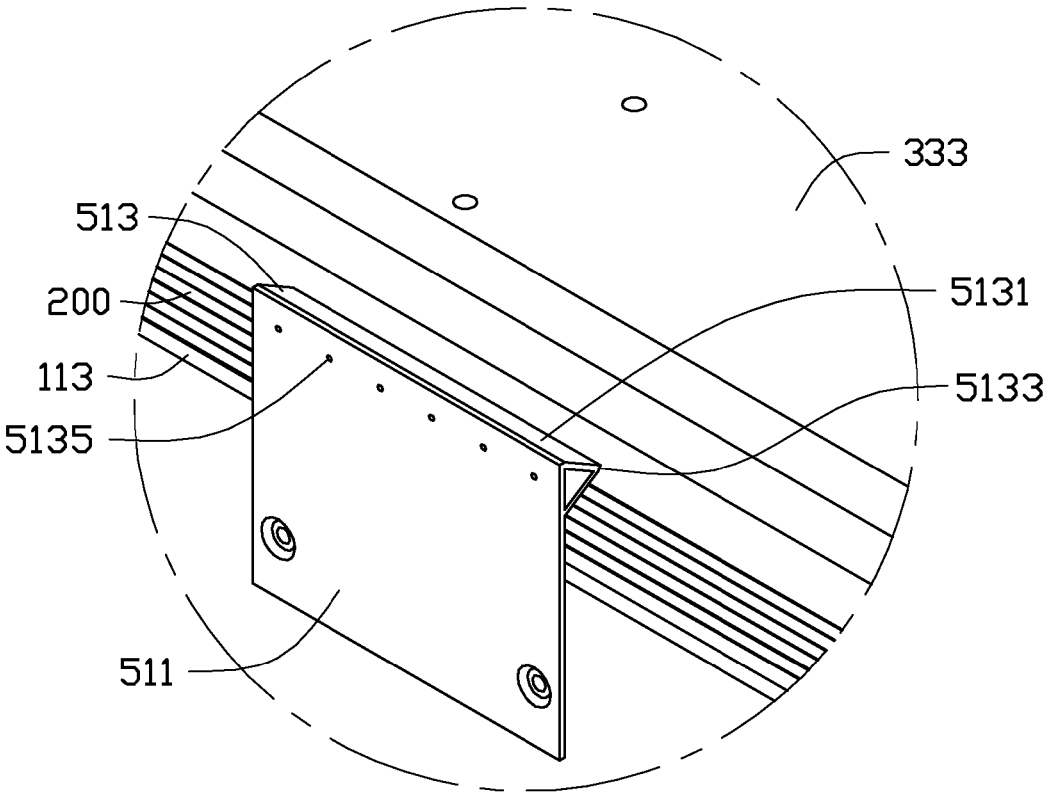
FIG. 4 is an enlarged, isometric view of a circled portion IV in FIG. 1.

FIGS. 1 and 2 show an absorbing mechanism 100, for absorbing a plurality of workpieces 200. The workpieces 200 are sheet-like. In the illustrated embodiment, the workpieces 200 are plastic films. The absorbing mechanism 100 includes a positioning assembly 10, an absorbing assembly 30, and at least one separating assembly 50. The positioning assembly 10 is constructed for receiving and positioning the workpieces 200. The absorbing assembly 30 is located above the positioning assembly 10, for absorbing a top workpiece 200 from the plurality of workpieces 200 stacking together. The at least one separating assembly 50 is mounted on the positioning assembly 10, for separating the top workpiece 200 and an adjacent workpiece 200 adjacent to the top workpiece 200 when the absorbing assembly 30 absorbing the top workpiece 200. Thus, the workpieces 200 is absorbed by the absorbing assembly 30 one by one. In the illustrated embodiment, there are four separating assemblies 50.

The positioning assembly 10 includes a receiving member 11, and two positioning members 13 received in the receiving member 11. The receiving member 11 is constructed for receiving the workpieces 200. The positioning members 13 are constructed for positioning the workpieces 200 received in the receiving member 11. The receiving member 11 includes a bottom plate 111 and a plurality of sidewalls 113 substantially perpendicularly protruding from edges of the bottom plate 111. The bottom plate 111 and the sidewalls 113 cooperatively define a receiving chamber 115, for receiving the workpieces 200. In the illustrated embodiment, the bottom plate 111 is substantially rectangular, and the number of the sidewalls 113 is four, correspondingly. An opening 117 is defined between adjacent sidewalls 113, for conveniently observing the amount of the workpieces 200 received in the receiving chamber 115. In an alternative embodiment, the four sidewalls 113 can be connected one by one, and no opening is defined between the adjacent sidewalls 113.

The positioning members 13 are rod-like, and are perpendicularly located on the bottom plate 111 and received in the receiving chamber 115. The positioning members 12 are configured to pass through the workpieces 200, for positioning the workpieces 200. In other embodiments, the positioning member 13 may be omitted, and the workpieces 200 can be positioned in the receiving chamber 115 only by the sidewalls 113.

The absorbing assembly 30 includes a driving member 31, and an attaching member 33 connected to the driving member 31. The driving member 31 is positioned above the receiving member 11. The driving member 31 drives the attaching member 33 to move toward the receiving member 11, and away from the receiving member 11 to a next process after the attaching member 33 absorbs the workpiece 200. In other embodiments, the driving member 31 can be omitted, and the attaching member 33 may be mounted to a robot arm (not shown) when in use, and the robot arm drives the attaching member 33 to move.

The attaching member 33 includes a connecting portion 331, an attaching portion 333 mounted on the connecting portion 331, and an air control unit 335. The connecting portion 331 is substantially a rod, and is positioned on the driving member 31, for connecting the driving member 31 with the attaching portion 333. The attaching portion 333 is mounted on a distal end of the connecting portion 331 away from the driving member 31, for absorbing workpieces 200. The attaching portion 333 includes a contacting surface 3331 at an end away from the connecting portion 331, and the contacting surface 3331 is substantially perpendicular to the connecting portion 331. The contacting surface 3331 defines a plurality of through holes 3332 at edges thereof. The through holes 3332 are arranged evenly, for allowing the attaching portion 333 to absorb workpiece 200 steadily. The air control unit 335 is communicated to the through holes 3332. When the contacting surface 3331 contacts the top workpiece 200, the air control unit 335 absorbs air between the contacting surface 3331 and the top workpiece 200 via the through holes 3332, thereby the attaching portion 333 absorbing the top workpiece 200. In the illustrated embodiment, the contacting surface 3331 is substantially rectangular, and an area of the contacting surface 3331 is smaller than an area of the workpiece 200 contacting with the contacting surface 3331. The air control unit 335 is a vacuum generator.

Each of the separating assembly 50 including a separating member 51 and an air source 53 communicating to the separating member 51. The separating member 51 includes a main body 511 and a detaching portion 513 connected to the main body 511. The main body 511 is substantially a rectangular plate. An end of the main body 511 away from the detaching portion 513 is mounted on corresponding one of the sidewalls 113, and an opposite end of the main body 511 protrudes from the corresponding sidewall 113. The detaching portion 513 is substantially a hollow triangular prism, and protrudes from the end of the main body 511 away from the sidewall 113 toward inside of the positioning assembly 10. The detaching portion 513 includes a first sidewall 5130, a second sidewall 5131, and a third sidewall 5132 connected end to end. The first sidewall 5130, the second sidewall 5131, and the third sidewall 5132 cooperatively define a substantially triangular prismatic chamber 515. The first sidewall 5130 extends from the end of the main body 511 protruding from the corresponding sidewall 113. The second sidewall 5131 and the third sidewall 5132 respectively protrude from opposite sides of the first sidewall 5130 towards an axis of the receiving member 11, and intersect with each other. A ridge of the second sidewall 5131 and the third sidewall 5132 forms an inclined surface 5133 towards the receiving chamber 115. The detaching portion 513 defines a plurality blow holes 5134. The blow holes 5134 communicate to the air source 53, for introducing air blowing towards the workpieces 200 received in the receiving chamber 115. In the illustrated embodiment, each of the blow holes 5134 includes a first through hole 5135 and a second through hole 5136 communicating to the first through hole 5135 via the chamber 515. The first through hole 5135 is defined at the first sidewall 5130 of the detaching portion 513. The second through hole 5136 is defined on the inclined surface 5133. The first through hole 5135 and the second through hole 5136 communicate to the chamber 515, and the first through hole 5135 communicates to the air source 53. The air source 53 communicates to the first through hole 5135, for supplying air to the blow holes 5134. In other embodiments, the air source 53 can be omitted, and the blow holes 5134 can be connected to an outer air source (not shown) when in use. The air source 53 can be directly connected to the second through hole 5136. The detaching portion 513 may be other shapes, such as a V-shape, and the second through hole can be defined at an end of the detaching portion 513 away from the main body 511.

In assembly, the positioning member 13 is mounted on the bottom plate 111, and received in the receiving chamber 115. The four separating members 51 are mounted on four sidewalls 113, respectively, and the detaching portions 513 protrude toward an inner side of the sidewalls 113. The air source 53 is positioned besides the receiving member 11, and communicate to the first through hole 5135. The driving member 31 is position above the receiving member 11. The attaching member 33 is connected to the driving member 31, and is located above the receiving member 11. The contacting surface 3331 parallel to the bottom plate 111 of the receiving member 11.

In use, a plurality of sheet-like workpieces 200 are received in the receiving chamber 115. The driving member 31 drives the attaching member 33 to absorb the top workpiece 200 from the workpieces 200 stacked together. The contacting surface 3331 contacts the top workpiece 200, and the air control unit 335 absorbs air between the contacting surface 3331 and the top workpiece 200 via the through holes 3332, thereby the top workpiece 200 is absorbed by the attaching member 33. Because the workpieces 200 are sheet-like workpieces, the workpieces 200 may stick together, thus more than one workpieces 200 are absorbed by the attaching member 33. During the absorbed workpieces 200 moving away from the receiving chamber 115, the inclined surface 5133 resists the workpieces 200 to deformed, thus a gap is defined between adjacent workpieces 200. Air from the air source 53 is blown into the gap via the first through hole 5135, the chamber 515, and the second through hole 5136, thereby separating the adjacent workpieces 200. Therefore, only the top workpiece 200 is separated from the workpieces 200 stacked together, and other workpieces 200 are dropped into the receiving chamber 115. The driving member 31 drives the workpiece 200 to a next process.

It is believed that the present embodiments and their advantages will be understood from the foregoing description, and it will be apparent that various changes may be made thereto without departing from the spirit and scope of the embodiments or sacrificing all of its material advantages.

What is claimed is:

1. An absorbing mechanism, comprising:

a positioning assembly defining a receiving chamber, the positioning assembly comprising a receiving member, the receiving member comprising a bottom plate and a plurality of sidewalls protruding from edges of the bottom plate, the receiving chamber defined by the bottom plate and the sidewalls;

an absorbing assembly comprising a driving member and an attaching member connected to the driving member; and at least one separating assembly comprising a separating member, the separating member comprising:

a main body mounted on the plurality of sidewalls, and a detaching portion protruding from the main body toward an axis of the receiving chamber and defining a blow hole at an end of the detaching portion away from the main body, the detaching portion defining a chamber, the blow hole comprising a first through hole and a second through hole, each of the first through hole and the second through hole communicating to the chamber, the detaching portion being substantially a triangular prism and comprising a first sidewall, a second sidewall, and a third sidewall connected end to end, the first through hole defined at the first sidewall, the first sidewall coplanar with the main body, the second sidewall and the third sidewall protruding from opposite sides of the first sidewall towards the axis of the receiving member, and intersecting with each other.

2. The absorbing mechanism of claim 1, wherein the positioning assembly further comprises at least one positioning member mounted on the bottom plate, and the positioning member is received in the receiving chamber.

3. The absorbing mechanism of claim 1, wherein the detaching portion forms an inclined surface at the end away from the main body, the second through hole is defined at the inclined surface.

4. The absorbing mechanism of claim 3, wherein the inclined surface is formed at a ridge of the second sidewall and the third sidewall.

5. The absorbing mechanism of claim 1, wherein the attaching member comprises a connecting portion, an attaching portion mounted on the connecting portion, and an air control unit mounted on the attaching portion, the connecting portion is mounted on the driving member, the driving member drives the attaching portion to move.

6. The absorbing mechanism of claim 5, wherein the attaching portion comprises a contacting surface at an end away from the connecting portion, the contacting surface defines a plurality of through holes, the air control unit communicates to the through holes.

7. The absorbing mechanism of claim 1, wherein the separating assembly further comprises an air source, the air source communicates to the blow hole.

8. An absorbing mechanism, comprising:

a positioning member defining a receiving chamber, for receiving a plurality of workpieces, the positioning assembly comprising a receiving member, the receiving member comprising a bottom plate and a plurality of sidewalls protruding from edges of the bottom plate, the receiving chamber defined by the bottom plate and the sidewalls;

an attaching member for absorbing the workpieces; and at least one separating member comprising:

a main body mounted on the plurality of sidewalls, and a detaching portion protruding from the main body toward an axis of the receiving chamber, and forming an inclined surface away from the main body, the inclined surface defining at least one blow hole, the inclined surface towards the receiving chamber, the detaching portion defining a chamber, the blow hole comprising a first through hole and a second through hole, each of the first through hole and the second through hole communicating to the chamber, the detaching portion being substantially a triangular prism and comprising a first sidewall, a second sidewall, and a third sidewall connected end to end, the first through hole defined at the first sidewall, the second through hole defined at the inclined surface, the first sidewall coplanar with the main body, the second sidewall and the third sidewall protruding from opposite sides of the first sidewall towards the axis of the receiving member, and intersecting with each other.

9. The absorbing mechanism of claim 8, wherein the absorbing mechanism further comprises at least one positioning member mounted on the bottom plate, and the positioning member is received in the receiving chamber.

10. The absorbing mechanism of claim 8, wherein the inclined surface is formed at a ridge of the second sidewall and the third sidewall.

11. The absorbing mechanism of claim 8, wherein the absorbing mechanism further comprises a driving member, the attaching member comprises a connecting portion, an attaching portion mounted on the connecting portion, and an air control unit mounted on the attaching portion, the connecting portion is mounted on the driving member, the driving member drives the attaching portion to move.

12. The absorbing mechanism of claim 11, wherein the attaching portion comprises a contacting surface at an end away from the connecting portion, the contacting surface defines a plurality of through holes, the air control unit communicates to the through holes.

13. The absorbing mechanism of claim 8, wherein the absorbing mechanism further comprises an air source, the air source communicates to the blow hole.

* * * * *